US006216665B1

(12) United States Patent
Okamoto et al.

(10) Patent No.: US 6,216,665 B1
(45) Date of Patent: Apr. 17, 2001

(54) FUEL INJECTOR AND INTERNAL COMBUSTION ENGINE HAVING THE SAME

(75) Inventors: Yoshio Okamoto, Minori-machi; Yzo Kadomukai, Ishioka; Yoshiyuki Tanabe; Yasunaga Hamada, both of Hitachinaka, all of (JP)

(73) Assignees: Hitachi, Ltd., Tokyo; Hitachi Car Engineering Co., Ltd., Ibaraki, both of (JP)

( * ) Notice: Subject to any disclaimer, the term of this patent is extended or adjusted under 35 U.S.C. 154(b) by 0 days.

(21) Appl. No.: 09/629,731

(22) Filed: Jul. 31, 2000

Related U.S. Application Data

(63) Continuation of application No. 09/030,082, filed on Feb. 25, 1998, now Pat. No. 6,125,818.

(30) Foreign Application Priority Data

Mar. 19, 1997 (JP) ..... 9-66076

(51) Int. Cl.[7] ..... F02B 3/04; F02B 17/00
(52) U.S. Cl. ..... 123/305; 239/466
(58) Field of Search ..... 123/301, 305, 123/295; 239/463, 466, 533.3, 584, 472, 473, 494, 496

(56) References Cited

U.S. PATENT DOCUMENTS

| | | | |
|---|---|---|---|
| 3,081,952 | 3/1963 | Woodward et al. | 239/464 |
| 3,100,084 | 8/1963 | Biber | 239/463 |
| 4,105,163 | 8/1978 | Davis, Jr. et al. | 239/406 |
| 4,166,577 | 9/1979 | Elwell | 239/182.2 |
| 4,192,466 | 3/1980 | Tanasawa et al. | 239/464 |
| 5,098,016 | 3/1992 | Okamoto et al. | 239/5 |
| 5,713,205 | 2/1998 | Sciocchetti et al. | 60/740 |
| 5,740,777 | 4/1998 | Yamamoto et al. | 123/305 |
| 6,095,113 * | 8/2000 | Nogi et al. | 123/295 |

FOREIGN PATENT DOCUMENTS

| | | |
|---|---|---|
| 5-33739 | 2/1993 | (JP) . |
| WO96/36808 | 11/1996 | (WO) . |

* cited by examiner

*Primary Examiner*—Willis R. Wolfe
*Assistant Examiner*—Hai Huynh
(74) *Attorney, Agent, or Firm*—Antonelli, Terry, Stout & Kraus, LLP

(57) ABSTRACT

A laminated structure fuel swirl element is employed, in which a strong swirl force flow is imparted to the fuel at a remote side against an injection hole and on the other hand, at a near side of the fuel injection hole, a weak swirl force is imparted to the fuel. A complex solid cone spray can be obtained, such a spray has a superior a dispersion characteristic by attracting small diameter droplets which are generated at an outer peripheral portion of the spray through a spray which is generated at a vicinity of a central portion of the spray and has a large velocity. In the spray characteristics in an electromagnetic system fuel injector of a direct injection gasoline engine, a complex solid cone spray can be obtained, as a result a good ignitability of the engine can be obtained by a spray having a small spreading angle by making strong an inertia force and a discharge amount of the unburned gas components of the combustion can be reduced by a spray having a short reaching distance and a large spreading angle by making weak the inertia force.

3 Claims, 7 Drawing Sheets

FUEL INJECTOR AND INTERNAL COMBUSTION ENGINE HAVING THE SAME

CROSS-REFERENCE TO RELATED APPLICATION

This application is a continuation of application Ser. No. 09/030,082, filed on Feb. 25, 1998, now U.S. Pat. No. 6,125,818, the entire disclosure of which is hereby incorporated by reference.

BACKGROUND OF THE INVENTION

The present invention relates to a fuel injector and an internal combustion engine having a fuel injector and, in particularly to a fuel injector in which a fuel spray having a superior ignitability and a superior combustibility is formed and an internal combustion engine having a fuel injector.

The present invention relates a fuel injector for forming a complex fuel spray having a superior ignitability and a superior combustibility and an internal combustion engine having a fuel injector.

An inlet pipe fuel injection device has known, in such a fuel injection device the fuel is injected into an inlet pipe of an internal combustion engine and in addition to the above stated inlet pipe fuel injection device a direct fuel injection device has known, in such a fuel injection device the fuel is injected directly into a combustion chamber (a cylinder). Such a latter stated conventional direct fuel injection device is disclosed in, for example, Japanese patent laid-open publication No. Hei 5-33,739.

As disclosed in the above stated Japanese patent laid-open publication No. Hei-5 33,739, it is difficult to mix homogeneously the fuel which has injected directly to the combustion chamber with the inhale air in the combustion chamber. Therefore, it is important to produce a promotion for atomizing the fuel which has injected directly to the combustion chamber.

To atomize the fuel, up to now an impartment of a swirling force with the fuel which is injected from a fuel injector has carried out. As shown in the above stated Japanese patent laid-open publication No. Hei-5 33,739, the direct fuel injection device having a means for imparting the swirling force against the fuel is disclosed.

Herein, the direct fuel injection device shown in the above stated Japanese patent laid-open publication No. Hei-5 33,739, the direct fuel injection device comprises an injection nozzle for injecting the fuel from an injection hole, a cylindrical shape cover having a bottom portion for constituting an air chamber at an outer side of the injection nozzle, a swirl chamber which is formed at a side of the bottom portion of the cover to communicate to the injection hole of the injection nozzle, and a check valve body which opens and closes the injection hole.

With the above stated conventional direct fuel injection device structure, the swirl chamber has an injection hole and this injection hole introduces the assist air from a tangential direction directing for an inner peripheral face of the swirl chamber from the air chamber which is constituted the cylindrical shape cover having the bottom portion. In accordance with the above stated assist air which is injected from the injection hole of the swirl chamber, the fuel for injecting to the injection hole of the injection nozzle can be imparted the swirl force.

Further, the injection hole and a passage for introducing the assist air from the air chamber to the swirl chamber are provided with two stages structure, namely the injection hole and the passage of the swirl chamber are provided at an upper direction and a lower direction (an axial direction of the check valve body) or an upstream side and at a downstream side of the check valve body. Each of the injection hole and the passage of the swirl chamber at the upper direction and the lower direction have the same structure.

However, in the above stated conventional direct fuel injection device, the check valve is arranged at a discharge side. Further, the swirl force impartment means is provided at a downstream side of a metering portion of the fuel but is not provided at an upstream side of the metering portion of the fuel.

As a result, after the fuel passes through the metering portion of the fuel without the impartment of the swirl force, the fuel is imparted first the swirl force at the downstream side of the metering portion of the fuel, namely the swirl force is imparted first the swirl force in the swirl chamber according to the assist air.

Accordingly, in the conventional direct fuel injection device structure shown in the above stated Japanese patent laid-open publication No. Hei-5 33,739, there is no idea about the impartment of the swirl force with the fuel using a fuel passage at the upstream of the metering portion of a valve body.

In the conventional technique including the above stated direct fuel injection device, it has promoted the atomization for the fuel and it has devised about spray direction of the fuel and a spreading of the fuel spray. However, as stated in hereinafter, there is not taken fully a consideration with respect to a spray shape of the fuel, a spray diameter of the fuel and a spray structure of the fuel in which both of the ignitability (a spark-in property) and the combustibility (a propagation of fire) are improved compatibly.

To attain the optimum property for the spray of the fuel which is injected from the fuel injector, it is necessary to consider at least following three characteristics.

First of all, the first characteristic is the fuel spray shape and factors for this fuel spray shape are a spreading angle and a reaching distance of the fuel. The second characteristic is a size of the spray fuel particle and it is necessary to lessen a number of a large spray fuel particle size as possible and to make an uniformity of a spray fuel particle size distribution. The third characteristic is a spray structure of the fuel and it is necessary to suit properly a spatial distribution of the fuel particle to be sprayed.

The inventors of the present invention have studied about the various experimentation analyses in which how these fuel spray characteristics relate to the combustion properties in the internal combustion engine.

As the results of the studies, they found out following facts, that is in a case where by making large the spreading angle of the spray of the fuel an inertia force of the fuel spray is made weak and then the reaching distance of the fuel spray is made short, it is effective to obtain the stability of the combustion. Further, on the other hand, by making small the spreading angle of the spray of the fuel the inertia force of the fuel spray is made strong and then the mixture air having a superior ignitability is generated, but it was ascertained clearly that it has a tendency in which the unburned gas components (HC, CO) of the fuel increase, etc.

SUMMARY OF THE INVENTION

An object of the present invention is to provide a fuel injector which can inject a complex solid cone fuel spray including a fuel spray having a superior combustibility in which a discharge amount of an unburned gas component can be reduced and a fuel spray for improving an ignitability and an internal combustion engine having a fuel injector.

Another object of the present invention is to provide a fuel injector which can inject a complex solid cone fuel spray including a fuel spray having a superior combustibility in which a discharge amount of an unburned gas component can be reduced and a fuel spray for improving an ignitability and an internal combustion engine having a fuel injector so as to obtain a superior ignitability of the internal combustion engine and to reduce the discharge amount of the unburned gas component of the fuel.

As to the complex solid cone fuel spray in the fuel injector, it is desirable to form the fuel spray which comprises a first fuel spray having a large spreading angle by making weak an inertia force and making short a reaching distance and a second fuel spray having a small spreading angle by making strong an inertia force.

So as to obtain the above complex solid cone fuel spray in the fuel injector, a fuel injector according to the present invention comprises a nozzle body having an injection hole, a valve body, and a drive means for driving the valve body toward an axial direction, by driving the valve body the injection hole is opened and closed and the fuel injection is carried out.

In the fuel injector, at a side of an upstream of the injection hole, two swirl force impartment means for imparting a swirl force to the fuel are arranged toward the axial direction, the two swirl force impartment means comprise a first swirl force impartment means and a second swirl force impartment means, and a swirl force imparted by the first swirl force impartment means differs from a swirl force imparted by the second swirl force impartment means, thereby the fuel injection having a solid cone spray is carried out.

In a fuel injector according to the present invention, at a side of an upstream of the injection hole, two swirl force impartment means for imparting a swirl force to the fuel are arranged with a two stage form toward the axial direction, the two swirl force impartment means comprise an upstream side swirl force impartment means and a downstream side swirl force impartment means, and the upstream side swirl force impartment means imparts a stronger swirl force to the fuel than a swirl force of the downstream side swirl force impartment means, thereby the fuel injection having a solid cone spray is carried out.

The fuel which is imparted to the strong swirl force forms a first fuel spray having the large spreading angle by weakening the inertia force and making short the reaching distance. The fuel which is imparted to the weak swirl force forms a second fuel spray having the small spreading angle by making strong the inertia force. The complex solid cone fuel spray is formed by the first fuel spray and the second fuel spray.

In a fuel injector according to the present invention to which by imparting a swirl force to the fuel the fuel is injected, from an injection hole, a preceding spray is injected to a central portion, and in succession to the preceding spray, another spray is injected radially to a surrounding portion of the preceding spray, thereby the fuel injection having a solid cone spray is carried out.

In a fuel injector according to the present invention to which by imparting a swirl force to the fuel the fuel is injected, a cross-section of a spray shape including an axial center of a valve body of the fuel injector has strong spray distributions toward three directions, thereby the fuel injection having a solid cone spray is carried out.

The preceding fuel spray at the central portion attracts the small diameter droplets, such small diameter droplets are injected continuously to the preceding fuel at a surrounding portion of the preceding fuel with a hollow shape spray and with a radial shape spray. As a result, the solid cone fuel spray structure having a superior dispersion property can be formed.

The fuel spray which precedes at the central portion is mainly the fuel spray according to the fuel which is imparted the weak swirl force. The fuel spray which continues to the above fuel spray and is injected with the radial shape spray is mainly the fuel spray according to the fuel which is imparted the strong swirl force.

In this time, according to a high speed photograph by making visually the fuel spray structure in the fuel injection, it was observed that the fuel spray which is injected at the central portion reaches to a remote portion from the fuel spray which is sprayed at the surrounding portion with the radial shape spray. In this time, a cross sectional face of the fuel spray structure will have following characteristics.

Namely, in the fuel injector obtained according to the present invention, in the fuel injector which injects the fuel by imparting the swirl force to the fuel, the cross sectional face of the fuel spray structure including the axial center has the fuel spray having the strong fuel spray at three directions.

A fuel injector according to the present invention comprises at a side of an upstream of the injection hole, two swirl force impartment means for imparting a swirl force to the fuel are arranged with a two stage form toward the axial direction, the two swirl force impartment means comprise an upstream side swirl force impartment means and a downstream side swirl force impartment means, and the upstream side swirl force impartment means imparts a weaker swirl force to the fuel than a swirl force of the downstream side swirl force impartment means, thereby the fuel injection having a solid cone spray is carried out.

In a fuel injector according to the present invention to which by imparting a swirl force to the fuel the fuel is injected, from an injection hole, a preceding spray is injected radially to a surrounding portion, and in succession to the preceding spray, another spray is injected to a central portion of the preceding spray, thereby the fuel injection having a solid cone spray is carried out.

A fuel injector according to the present invention comprises a nozzle body having an injection hole for injecting the fuel and a seat face provided at a side of an upstream of the injection hole, a valve body for carrying out an opening operation and a closing operation of a fuel passage at the seat face of the nozzle body, at a side of an upstream of the seat face of the nozzle body, an element having a penetration hole in which the valve body penetrates and for constituting an axial direction fuel passage for passing through the fuel toward an axial direction and a radial direction fuel passage for communicating the penetration hole from the axial direction passage and for passing through the fuel toward a radial direction.

The radial direction fuel passage has a first radial direction passage and a second radial passage toward the axial direction, an off-set amount of the first radial direction passages differs from an off-set amount of the second radial direction passage, thereby the fuel injection having a solid cone spray is carried out.

The radial direction fuel passage has two radial direction passage which are provided with a two stage form at the axial direction, an off-set amount from an axial center of the valve body of one of the two radial direction passages, which is provided at a remote portion from the injection hole and is provided at an opening of a side of the penetration hole at a side of an upstream, is made the same or larger than an off-set amount of an opening of another radial direction passage which is provided at a near side of the injection hole, thereby the fuel injection having a solid cone spray is carried out.

According to the above stated fuel injector, a flow direction of the fuel which passes through the radial direction passage remote from the injection hole turns away a side of the axial center of the valve body from the flow of the fuel which passes through the radial direction passage near to the injection hole. As a result, the fuel which has imparted the strong swirl force at the upstream side is injected continuously from the injection hole to the fuel which has imparted the weak swirl force at the downstream side. As reasons stated in above, the complex solid cone fuel spray is formed.

A fuel injector according to the present invention comprises at a side of an upstream of the seat face of the nozzle body, an element having a penetration hole in which the valve body penetrates and for constituting an axial direction fuel passage for passing through the fuel toward an axial direction and a radial direction fuel passage for communicating the penetration hole from the axial direction passage and for passing through the fuel toward a radial direction.

The radial direction fuel passage has two radial direction passage which are provided with a two stage form at the axial direction, an off-set amount from an axial center of the valve body of one of the two radial direction passages, which is provided at a remote portion from the injection hole and is provided at an opening of a side of the penetration hole at a side of an upstream, is made smaller than an off-set amount of an opening of another radial direction passage which is provided at a near side of the injection hole, thereby the fuel injection having a solid cone spray is carried out.

An internal combustion engine having a fuel injector according to the present invention comprises a cylinder, a piston which reciprocates in the cylinder, an air intake means for introducing the air into the cylinder, a discharge means for discharging the combustion gas from the cylinder, a fuel injector for injecting directly the fuel into the cylinder, a fuel supply means for supplying the fuel from a fuel tank to the fuel injector, and an ignition means for igniting a mixture air which comprises the air introduced in the cylinder by the air intake means and the fuel injected into the cylinder by the fuel injector, the internal combustion engine.

The fuel injector of the internal combustion engine comprises a nozzle body having an injection hole, a valve body for carrying out an opening operation and a closing operation of the injection hole, a drive means for driving the valve body at an axial direction, and a first swirl force impartment means and a second swirl force impartment means which are provided at an upstream side of the injection hole and are arranged toward the axial direction.

In an internal combustion engine having a fuel injector according to the present invention, a swirl force imparted by the first swirl force impartment means differs from a swirl force of the second swirl force impartment, thereby the fuel injection having a solid cone spray is carried out.

The fuel injector of the internal combustion engine comprises two swirl force impartment means which are provided at an upstream side of the injection hole and are arranged toward the axial direction with a two stage form.

In the internal combustion engine, between the two swirl force impartment means, a swirl force impartment means which is provided at an upstream side imparts a stronger swirl force to the fuel than a swirl force of another swirl force impartment which is provided at a downstream side, thereby the fuel having a solid cone spray is injected into the cylinder.

An internal combustion engine having a fuel injector according to the present invention comprises a means for imparting a swirl force to the fuel and for injecting the fuel, and the fuel is injected into the cylinder in such a manner in which the velocity of a spray which is injected to a central portion from an injection hole is made larger than the velocity of another spray which is injected radially at a surrounding portion of the above-mentioned spray from the injection hole, thereby the fuel injection having a solid cone spray is carried out.

In an internal combustion engine having a fuel injector according to the present invention, between the two swirl force impartment means, a swirl force impartment means which is provided at an upstream side imparts a weaker swirl force to the fuel than a swirl force of another swirl force impartment which is provided at a downstream side, thereby the fuel having a solid cone spray is injected into the cylinder.

An internal combustion engine having a fuel injector according to the present invention comprises a means for imparting a swirl force to the fuel and for injecting the fuel; and the fuel is injected into the cylinder in such a manner in which the velocity of a spray which is injected to a surrounding portion from an injection hole is made smaller than the velocity of another spray which is injected radially at a surrounding portion of the above-mentioned spray from the injection hole, thereby the fuel injection having a solid cone spray is carried out.

An internal combustion engine having a fuel injector according to the present invention comprises means for imparting a swirl force to the fuel and for injecting the fuel, and the fuel is injected into the cylinder in a such manner in which a cross-section of a spray shape including an axial center of the valve body of the fuel injector has strong spray distributions toward three directions, thereby the fuel injection having a solid cone spray is carried out.

An internal combustion engine having a fuel injector according to the present invention, the fuel injector comprises an element provided at a side of an upstream side of the seat face of the nozzle body, the element has a penetration hole in which the valve body penetrates and for constituting an axial direction fuel passage for passing through the fuel toward the axial direction and a radial direction fuel passage for communicating the penetration hole from the axial direction passage and for passing through the fuel toward a radial direction.

The radial direction fuel passage has a first radial direction passage and a second radial direction passage which are provided toward the axial direction, an off-set amount of the first radial direction passage differs from an off-set amount of the second radial direction passage, and in accordance with the first radial direction passage and the second radial direction passage, the fuel is imparted a different force, thereby the fuel injection having a solid cone spray is carried out.

An internal combustion engine having a fuel injector, the radial direction fuel passage has two radial direction passage which are provided with a two stage form at the axial direction, an off-set amount from an axial center of the valve body of one of the two radial direction passages, which is provided at a remote portion from the injection hole and is provided at an opening of a side of the penetration hole at a side of an upstream, is made the same or larger than an off-set amount of an opening of another radial direction passage which is provided at a near side of the injection hole, and in accordance with the two radial direction passages, the fuel is imparted a different force and the obtained fuel is injected into the cylinder, thereby the fuel injection having a solid cone spray is carried out.

An internal combustion engine having a fuel injector according to the present invention, an off-set amount from an axial center of the valve body of one of the two radial direction passages, which is provided at a remote portion from the injection hole and is provided at an opening of a side of the penetration hole at a side of an upstream, is made smaller than an off-set amount of an opening of another radial direction passage which is provided at a near side of the injection hole, and in accordance with the two radial direction passages, the fuel is imparted a different force and the obtained fuel is injected into the cylinder, thereby the fuel injection having a solid cone spray is carried out.

The piston has a cavity portion at an upper face thereof and the cavity portion changes a direction of a spray shape which is injected from the fuel injector to the ignition means.

According to the internal combustion engine obtained by the present invention stated in above, since the complex fuel spray is formed in the cylinder, the superior ignitability in the internal combustion engine can be obtained and the combustibility in the internal combustion engine can be improved, as a result the discharge amount of the unburned gas components of the combustion can be reduced.

In this time, since the fuel is injected to direct for the cavity portion which is constituted on the upper face of the piston, the fuel spray having the strong inertia force which has imparted the weak swirl force collides vigorously with the cavity portion and the direction of the fuel is changed toward the ignition device (an ignition plug). Since the fuel which is changed its direction and has the strong inertia force attracts the small diameter droplets at the surrounding portion and further promotes the dispersion, as a result the ignitability can be improved and the combustibility in the internal combustion engine can be improved further.

DESCRIPTION OF THE INVENTION

Figure 9:
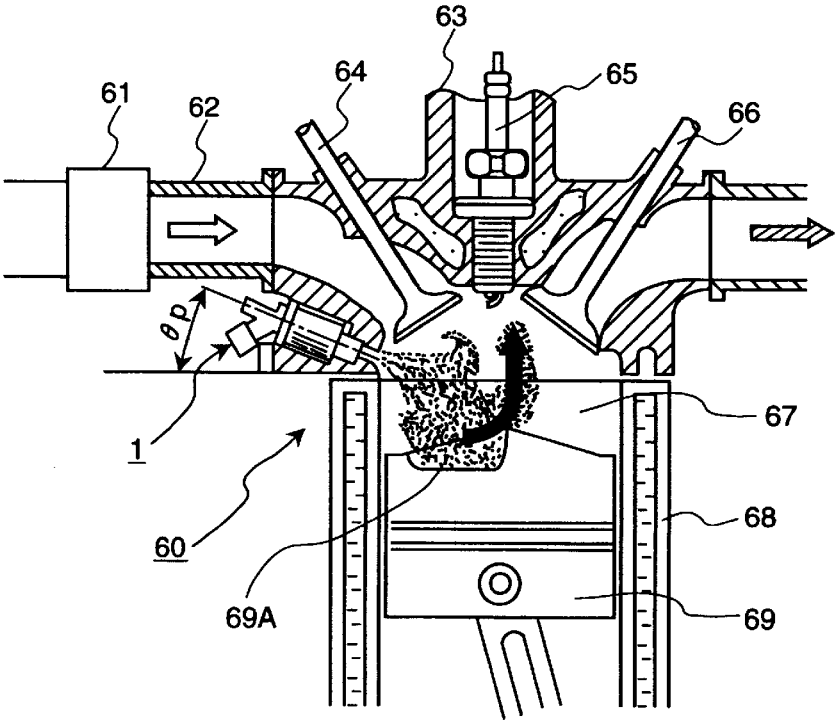
FIG. 9 is an explanatory view showing one embodiment of an essential portion of a direct injection system internal combustion engine having a fuel injector according to the present invention.

First of all, FIG. 9 shows a direct fuel injection device which is a subject matter to be studied by the inventors according to the present invention and an internal combustion engine on which the direct fuel injection device is mounted.

The direct fuel injection device (hereinafter, it is called as an electromagnetic system fuel injector) is installed to a cylinder head with an inclination of 30°–40° degree. An injection direction of the fuel is directed for a piston cavity (a dent portion provided on a piston). To obtain the optimum property of a fuel spray which is injected from this kind of the electromagnetic system fuel injector, it is necessary to study following characteristics.

The first characteristic is a fuel spray shape and factors for this fuel spray shape are comprised of a spreading angle and a reaching distance of the fuel. The second characteristic is a size of a spray fuel particle and it is necessary to lessen a number of a large fuel particle size as possible and to make an uniformity of a fuel particle size distribution. The third characteristic is a fuel spray structure and it is necessary to suit properly a spatial distribution of the fuel particle to be sprayed.

The inventors of the present invention have studied about the various experimentation analyses in which how these fuel spray characteristics relate to the combustion properties in the internal combustion engine. As the results of the studies, they found out following facts that when by making large the spreading angle of the fuel spray an inertia force of the fuel spray is made weak and then the reaching distance of the fuel is made short, it is effective to obtain the stability of the combustion. Further, on the other hand, by making small the spreading angle of the fuel spray the inertia force of the fuel spray is made strong and then the mixture air having a superior ignitability is generated, but it was ascertained clearly that it has a tendency in which the unburned gas components (HC, CO) of the fuel increase, etc.

Following embodiments of a direct fuel injection device or a fuel injector and of an internal combustion engine on which the direct fuel injection device or the fuel injector is mounted according to the present invention are carried out in accordance with the above stated inventor's knowledge.

Figure 1A:
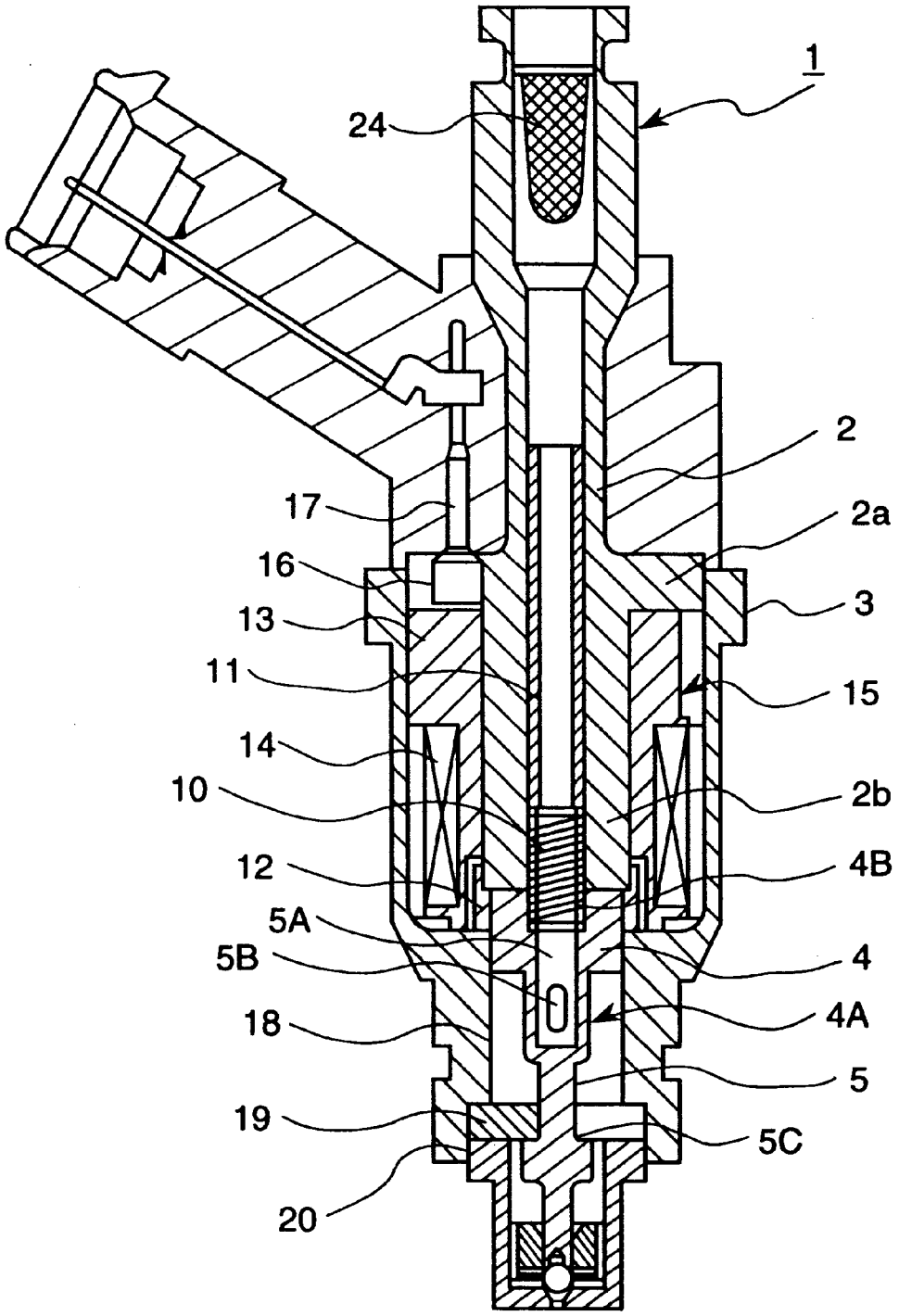
FIG. 1A is a cross-sectional view showing one embodiment of an electromagnetic system fuel injector according to the present invention.

Hereinafter, one embodiment of a fuel injector according to the present invention will be explained referring to FIGS. 1A and 1B, FIG. 2A–FIG. 2E and FIG. 3B. FIG. 1A is a cross-sectional view of one embodiment of an electromagnetic system fuel injector according to the present invention. Using FIG. 1A a structure and an operation of an electromagnetic system fuel injector 1 will be explained.

Figure 1B:
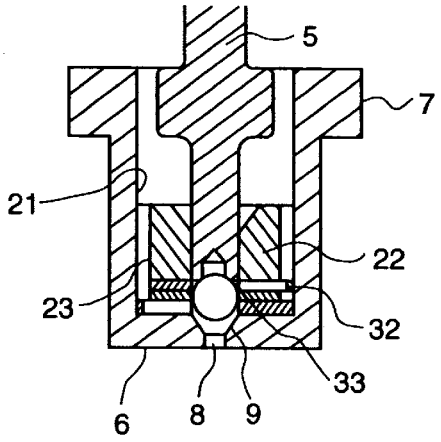
FIG. 1B is a longitudinal cross-sectional view one embodiment of a movable valve of a laminated layer structure fuel swirl element of the electromagnetic system fuel injector of FIG. 1A according to the present invention.
Figure 1C:
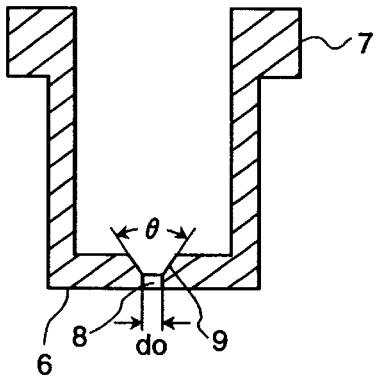
FIG. 1C is a longitudinal cross-sectional view one embodiment of a nozzle member which has an angle of a valve seat having θ and a diameter of a fuel injection hole having do of the electromagnetic system fuel injector of FIG. 1A according to the present invention.

FIG. 1B is a longitudinal cross-sectional view one embodiment of a movable valve of a laminated layer structure fuel swirl element of the electromagnetic system fuel injector and FIG. 1C is a longitudinal cross-sectional view one embodiment of a nozzle member which has an angle of a valve seat having θ and a diameter of a fuel injection hole having do of the electromagnetic system fuel injector.

The electromagnetic system fuel injector 1 carries out an open and close operation of a seat portion according to an ON-OFF signal of a duty which is executed by a control unit and further carries out an injection of fuel. A magnetic circuit comprises a cylindrical shape yoke 3 having a bottom portion, a core 2 having a plug body portion 2*a* for closing an opening end of the yoke 3 and a column shape portion 2*b* which extends over a central portion of the yoke 3, and a plunger 4 which is faced to the core 2 with a gap.

At a central portion of the column shape portion 2*b* of the core 2, a movable portion 4A and a hole 4B are provided. The movable portion 4A comprises the plunger 4, a rod 5, and a ball 6. The hole 4B holds a spring member 10 as an elastic material member and the spring member 10 is inserted to press a seat face 9 of an upstream side of a fuel injection hole 8. The fuel injection hole 8 is formed on a nozzle member 7 and allows to pass through the fuel therein.

An upper end of the spring member 10 is contacted to a lower end of a spring adjuster 11 which is inserted at a central portion of the core 2 to adjust a set load. A seal ring 12 is provided at a clearance portion which is faced at a side of the column shape portion 2*b* of the core 2 and a side of the movable portion 4A of the yoke 3. This seal ring 12 prevents an outflow of the fuel to a side of a coil 14 and is fixed mechanically between the column shape portion 2*b* of the core 2 and the movable portion 4A.

The coil 14 for exciting the magnetic circuit is wound to a bobbin 13 and an outer periphery of the coil 14 is molded by a plastic material member. A terminal 17 of a coil assembly body 15 comprises of the coil and the bobbin 13 is inserted to a hole 16 which is provided in the brim portion 2*a* of the core 2. This terminal member 17 is combined with the control unit (not shown in figure).

At the bottom portion of the yoke 3, a plunger receiving portion 18 for receiving the movable portion 4A is opened and a further plunger receiving portion 20 is penetrated through to a tip end of the yoke 3. The further plunger receiving portion 20 has a larger diameter than a diameter of the plunger receiving portion 18 and further a stopper member 19 and the nozzle member 7 are received therein.

The movable portion 4A comprises the plunger 4 made of a magnetic material, the rod 5 in which one end of rod 5 is integrally formed with the plunger 4 and the ball 6 which connected to a tip end portion of the rod 5. At a side of the plunger 4 of the rod 5, a cavity portion 5A for allowing the passage of the fuel. In this cavity portion 5A, an outflow port 5B for the fuel is provided.

Further, the move at an axial direction of the movable portion 4A is guided by contacting an outer periphery of the plunger 4 to the seal ring 12. At a vicinity of an end portion of the rod 5 to which the ball 6 is bonded, the movable portion 4A is guided according to an inner peripheral face 23 of a laminated layer structure fuel swirl element 22 according to the present invention which is inserted to a hollow portion of the nozzle member 7.

On the nozzle member 7, the laminated layer structure fuel swirl element 22 for guiding the vicinity of the end portion of the rod 5 on which the ball 6 is bonded is formed and successively the seat face 9 for seating the ball 6 is formed. At a central portion of a downstream of the seat face 9, the fuel injection hole 8 for allowing the passage of the fuel is provided. The fuel injection hole 8 has a diameter of do and the nozzle member 7 has an angle θ0 of the valve seat face 9.

Further, a stroke (a movement amount to an axial upper portion) of the movable portion 4A is determined by a size of a gap which is formed between a receiving face 5C of a neck portion of the rod 5 and the stopper member 19. Further, a filter 24 is provided to prevent an enter of dusts and foreign matters of in the fuel and in a piping to a side of a valve seat.

Herein, the structure of the laminated layer structure fuel swirl element 22 of the electromagnetic system fuel injector 1 according to the present invention will be explained.

Figure 2A:
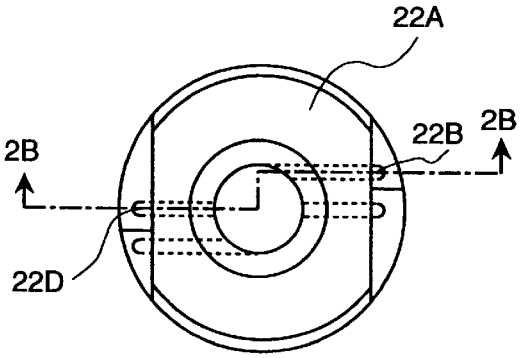
FIG. 2A is a plane view showing one embodiment of a laminated layer structure fuel swirl element of the electromagnetic system fuel injector of FIG. 1B according to the present invention.
Figure 2B:
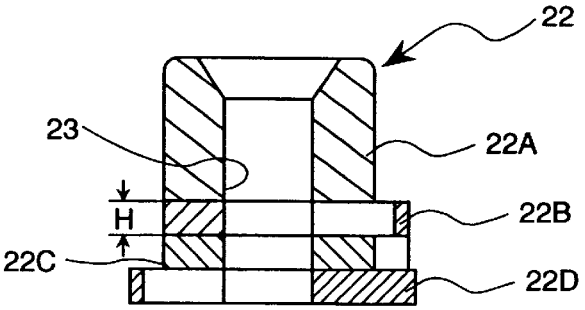
FIG. 2B is a longitudinal cross-sectional view showing one embodiment of the laminated layer structure swirl element of the electromagnetic system fuel injector taken along to a line 2B—2B in FIG. 2A according to the present invention.
Figure 2C:
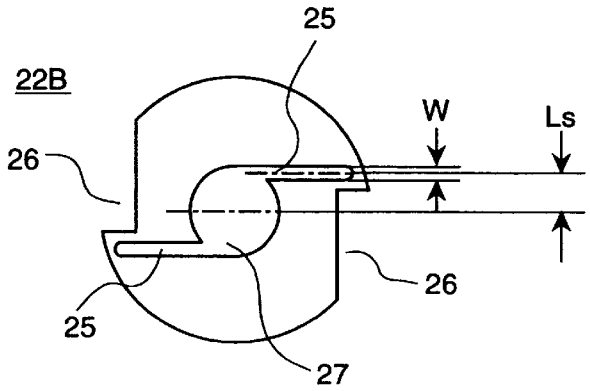
FIG. 2C is a plan view showing an upper plate 22B for constituting one embodiment of a fuel passage of the laminated layer structure fuel swirl element of the electromagnetic system fuel injector of FIG. 2B according to the present invention.

FIG. 2A is a plane view showing one embodiment of a laminated layer structure fuel swirl element 22 of the electromagnetic system fuel injector 1, FIG. 2B is a longitudinal cross-sectional view showing one embodiment of the laminated layer structure swirl element 22 of the electromagnetic system fuel injector 1, and FIG. 2C is a plan view showing an upper plate 22B for constituting one embodiment of a fuel passage of the laminated layer structure fuel swirl element 22 of the electromagnetic system fuel injector 1.

Figure 2D:
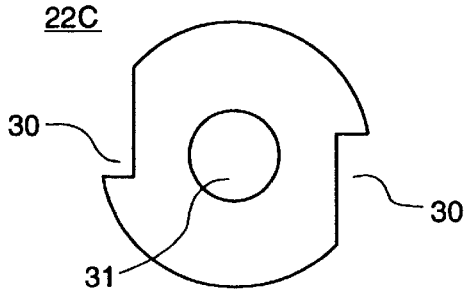
FIG. 2D is a plan view showing a middle plate 22C for constituting one embodiment of a fuel passage of the laminated layer structure fuel swirl element of the electromagnetic system fuel injector of FIG. 2B according to the present invention.
Figure 2E:
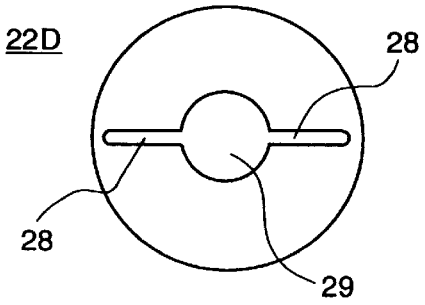
FIG. 2E is a plan view showing a lower plate 22D for constituting one embodiment of a fuel passage of the laminated layer structure fuel swirl element of the electromagnetic system fuel injector of FIG. 2B according to the present invention.
Figure 3A:
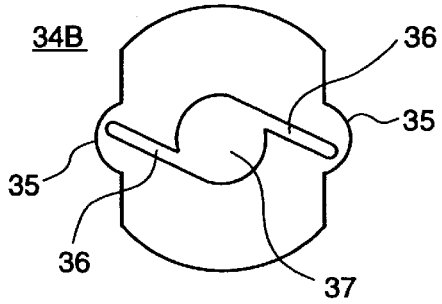
FIG. 3A is a plan view showing another upper plate 34B for constituting another embodiment of a fuel passage of a laminated layer structure fuel swirl element of an electromagnetic system fuel injector according to the present invention.
Figure 3B:
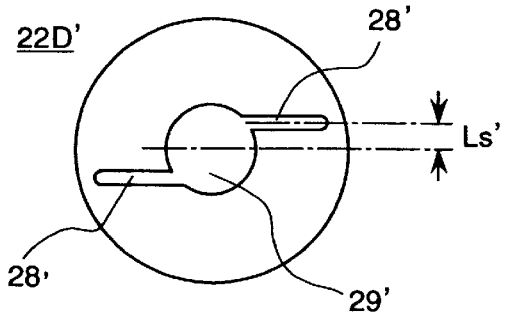
FIG. 3B is a plan view showing another lower plate 22D' for constituting another embodiment of a fuel passage of a laminated layer structure fuel swirl element of an electromagnetic system fuel injector according to the present invention.

FIG. 2D is a plan view showing a middle plate 22C for constituting one embodiment of a fuel passage of the laminated layer structure fuel swirl element 22 of the electromagnetic system fuel injector 1, FIG. 2E is a plan view showing a lower plate 22D for constituting one embodiment of a fuel passage of the laminated layer structure fuel swirl element 22 of the electromagnetic system fuel injector 1 and FIG. 3B is a plan view showing another lower plate 22D' for constituting another embodiment of a fuel passage of a laminated layer structure fuel swirl element of an electromagnetic system fuel injector 1.

The laminated layer structure fuel swirl element 22, as shown in FIG. 2B, comprises four pieces which are a cylindrical shape portion 22A, an upper plate 22B, a middle plate 22C, and a lower plate 22D. The cylindrical shape portion 22A has a guide hole 23 of the movable portion 4A.

Further, the upper plate 22B, as shown in FIG. 2C, has a pair of radial direction fuel passages 25 which are off-set respectively by a value of Ls from a center of an axis and two notch portions 26 and further has a hole 27 at a central portion. Such a central hole 27 communicates with the radial direction fuel passages 25 at a central portion.

Further, the lower plate 22D has a pair of radial direction fuel passages 28 which are not off-set and a hole 29 at a central portion, as shown in FIG. 2E. Such a central hole 29 communicates with the radial direction fuel passages 28.

Further, the middle plate 22C, as shown in FIG. 2D, has two notch portions 30 and a central hole 31 at a central portion. The central hole 27 provided on the upper plate 22B, the central hole 31 provided on the middle plate 22C, and the central hole 29 provided on the lower plate 22D are communicated in series.

In this time, as shown in FIG. 3B, each of the radial direction fuel passage 28' of the lower plate 22D' can be formed to have an off-set amount (Ls') (more than 0) smaller than the off-set amount (Ls) of the radial direction fuel passage 25 of the upper plate 22B shown in FIG. 2C.

In other words, it can set the off-set amount of the radial direction fuel passage 28 or 28' to obtain a desirable fuel spray in which a range of a swirl force imparted from the radial direction fuel passage 28 or 28' in a case where the fuel passes through the radial direction fuel passage 28 or 28' is smaller than a range of a swirl force imparted from the radial direction fuel passage 25 in a case where the fuel passes through the radial direction fuel passage 25.

The middle plate 22C, as shown in FIG. 2C, has two notch portions 30 and the central hole 31 at the central portion. Further, each of the central holes 27, 31, and 29 which are provided on each of the upper plate 22B, the middle plate 22C, and the lower plate 22D has the same diameter or little larger diameter than a diameter of the guide hole 23 of the cylindrical shape portion 22A.

Further, each of the plates 22B, 22C, and 22D is manufactured by punching out a very thin plate shape member with a disc shape and each of the holes 27, 31 and 29 and each of the notch portions 26 and 30 are formed with a similar press working.

As stated in above, since each of the plates 22B, 22C, and 22D is manufactured by a press formation working, a design freedom degree of the shape of each of the plates 22B, 22C, and 22D is high. For example, as to the provision of plural radial direction fuel passages, the provision of very slim fuel passage, the provision of a complicated fuel passage having a curve line, etc., the complicated and various shape plates can be manufactured with a high accuracy and at a low cost.

The four pieces comprised of the cylindrical shape portion 22A and the three plates 22B, 22C, and 22D are laminated in series as shown in FIG. 2B and after that they are fixed under pressure. This laminated layer structure fuel swirl element 22 of the fuel injector 1 is inserted and fixed to an inner wall of the hollow portion of the nozzle member 7 and then the axial direction passage of the fuel is formed between an outer peripheral wall of the fuel swirl element 22 and the inner wall of the hollow portion of the nozzle member 7. Further, by inserting the movable portion 4A, a fuel swirl chamber 33 is formed at an outer peripheral portion of the ball 6.

Namely, the fuel passage in which the fuel is introduced from an upper portion of the valve body is constituted and the fuel which has passed through an axial direction fuel passage 32 is introduced eccentricity from an axial center by the radial direction fuel passage 24 of the upper plate 22B. As a result, the fuel is imparted with a swirl structure.

Here, a swirl strength to be imparted (a swirl number S) is requested by a following formula.

$$S = (\text{angular movement amount}) / (\text{injection axial direction movement amount}) \times (\text{orifice radius})$$
$$= (2 \times do \times Ls) / (n \times ds^2 \times \cos\theta / 2)$$

Here, do: fuel injection hole diameter (orifice radius) (confer, FIG. 1C)

Ls: radial direction passage eccentricity amount (confer, FIG. 2C)

n: radial direction fuel passage number

θ: valve seat angle (confer, FIG. 1C)

ds: hydraulic equivalent diameter ds is expressed using a width W and a height H of radial direction fuel passage. (confer, FIG. 2B and FIG. 2C). Here, $$ds=(2\times W\times H)/(W+H)$$

This swirl number S is made large, the atomization is promoted and the fuel spray having the large spreading angle in which the inertia force is weaken is formed.

As understood from the above stated formula, the parameters for controlling the swirl force are the off-set amount (Ls) of the fuel passage and further a number (n) of the fuel passage and the hydraulic equivalent diameter (ds). Accordingly, to change the swirl force, in place of the operation of the off-set amount (Ls) according to this embodiment of the fuel injector 1, it can operate the number (n) of the fuel passage or the hydraulic equivalent diameter (ds). However in the latter case, since a difference in pressure loss generates in the fuel passage, a flow amount distribution which flows into each of the fuel passages differs.

As a result, it is necessary to design by taking into the consideration about these above stated points. On the other hand, since the off-set amount (Ls) of the fuel passage has a little affect about the above stated points, it can easily operate.

However, in a case where the design is carried out by paying fully consideration about the above stated points, as to the plural stages arrangement radial direction fuel passage it can change the number (n) of the fuel passage or the hydraulic equivalent diameter (ds).

Next, an operation of this embodiment of the fuel injector 1 thus constituted in above according to the present invention will be explained.

The fuel injector 1 carries out the opening and closing operation of the seat face 9 of the valve body of the nozzle member 7 by operating upwardly and downwardly the movable portion 4A toward the axial direction according to an electric ON-OFF signal which is given through the electromagnetic coil 14, as a result the injection control of the fuel is carried out.

When the electric signal is given to the coil 14, the core 2, the yoke 3 and the plunger 4 form a magnetic circuit and the plunger 4 is attracted to a side of the core 2. When the plunger 4 is moved, the ball 6 which is integrally formed with the plunger 4 is moved and then the ball 6 is separated from the seat face 9 of the valve body of the nozzle member 7, therefore the fuel injection hole 8 is opened.

As shown in FIG. 9, the fuel is pressurized and adjusted through a fuel pump 80 and a fuel pump 71 and a regulator 79 for adjusting the fuel pressure. The adjusted fuel flows into an inner portion of the fuel injector 1 from the filter member 24. And from an inner portion passage of the core 2, an outer peripheral portion of the plunger 4 and the hollow portion 5A which is provided in the plunger 4 and allows the passage of the fuel, the fuel reaches to a downstream through the outflow port 5B of the fuel.

The fuel passes through the gap formed between the stopper member 19 and the rod 5, the radial direction fuel passages 25 and 26 of the fuel swirl element 22 and the fuel is swirled and supplied to the seat portion, accordingly during the valve opening condition the fuel is injected from the fuel injection hole 8 into the combustion chamber of the internal combustion engine.

Figure 7A:
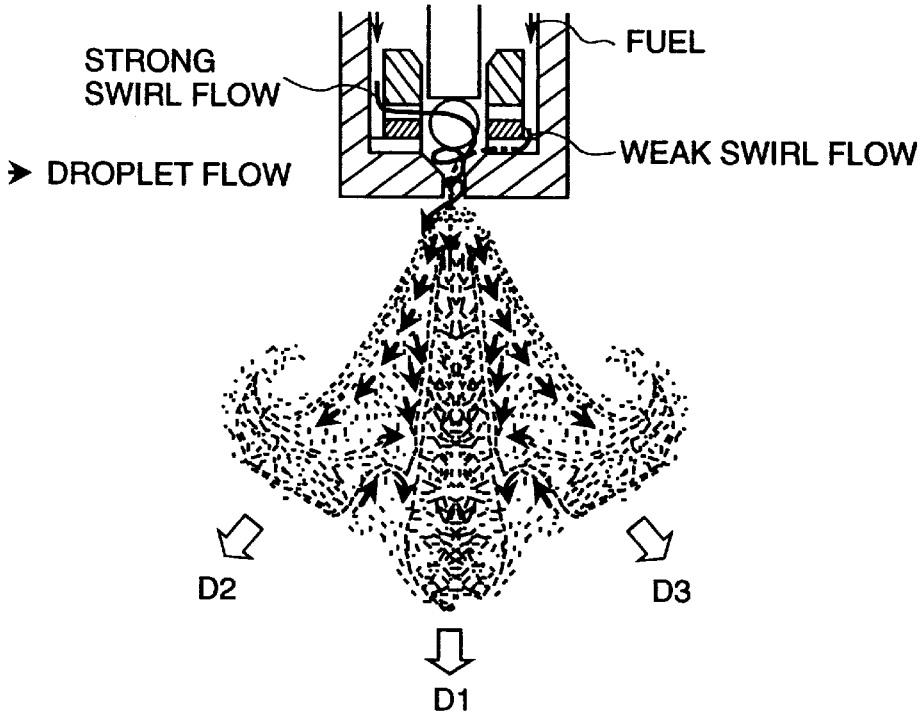
FIG. 7A is a schematic view showing a complex fuel spray structure in which a droplet flow is mainly explained according to the present invention.
Figure 7B:
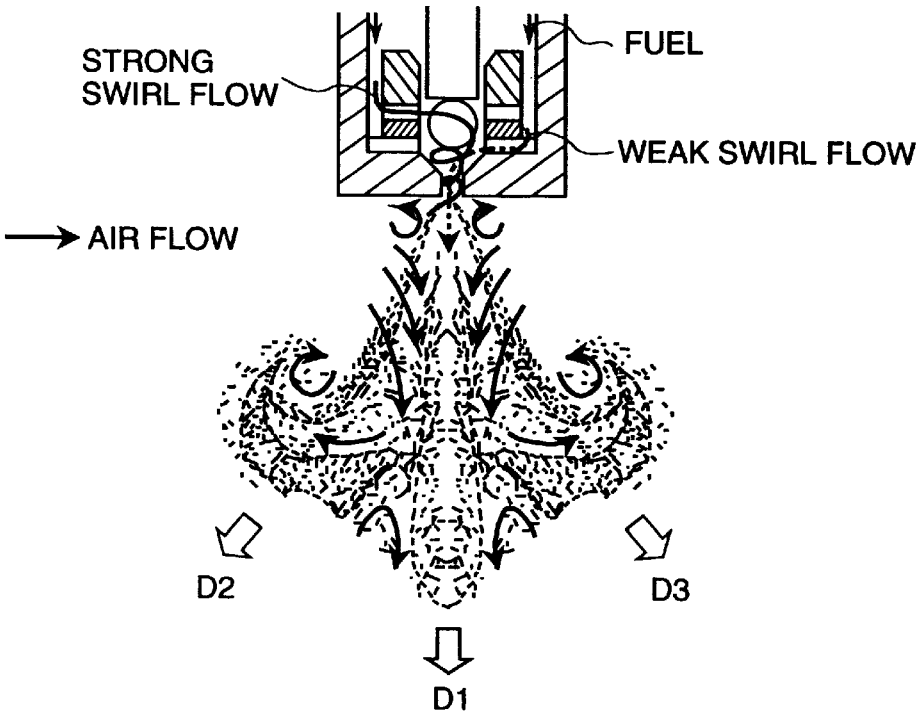
FIG. 7B is a schematic view showing a complex fuel spray structure in which an air flow is mainly explained according to the present invention.

As shown in FIG. 7A and FIG. 7B, the injected fuel becomes a complex fuel injection (a comparative solid cone fuel spray structure) in which the spray having the weak swirl force and the large spreading angle and the spray having the strong swirl force and the small spreading angle are mixed with.

Namely, the spray having the weak swirl force and the large spreading angle is generated by the upper plate 22B which is arranged remote from the seat face 9 of the nozzle member 7 and is promoted the atomization property according to the swirl force of the fuel which is imparted by the radial direction fuel passage 25.

On the other hand, the spray having the strong swirl force and the small spreading angle is generated by the lower plate 22D which is arranged near to the seat face 9 of the nozzle member 7 and has the weak swirl force which is imparted to the fuel in comparison with the above stated swirl force and is generated at a vicinity of the axial center as the spray flow having a large velocity.

The radial direction fuel passage 28 of the lower plate 22D has an off-set amount of zero (0) but in a case where the fuel is pushed out by the strong swirl flow from the radial direction fuel passage 25 of the upper plate 22B the swirl force is imparted and the fuel presents a weak swirl flow.

The spray flow from the radial direction fuel passage 28 which is imparted the weak swirl flow attracts surrounding air and also attracts the small diameter droplets which are performed the atomization property by imparting the strong swirl flow from the radial direction fuel passage 25. As a result, the fuel spray which presents the comparative solid cone fuel spray structure is generated.

FIG. 3A shows another embodiment of an upper plate 34B of a laminated structure fuel swirl element of the fuel injector 1 according to the present invention and this embodiment is a modified example of the radial direction passage 25 shown in FIG. 2C of the fuel. Namely, the upper plate 34B forms a projection shape semi-circular portion 35 in place of the notch portion shown in FIG. 2C. In this projection shape semi-circular portion 35, an end of the radial direction passage 36 of the fuel is constituted. By communicating the radial direction fuel passage 36, at central portion a central hole 37 is provided. In this embodiment of the fuel injector 1, the fuel is imparted fully the swirl force and the atomization property of the fuel is promoted and the fuel spray having a slow velocity and a weak inertia force is generated.

Figure 4A:
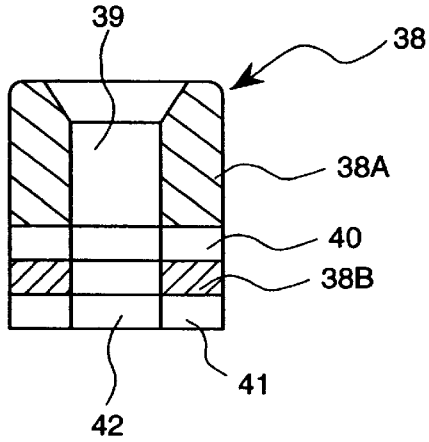
FIG. 4A is a longitudinal cross-sectional view showing a further embodiment of a laminated layer structure fuel swirl element of an electromagnetic system fuel injector according to the present invention.
Figure 4B:
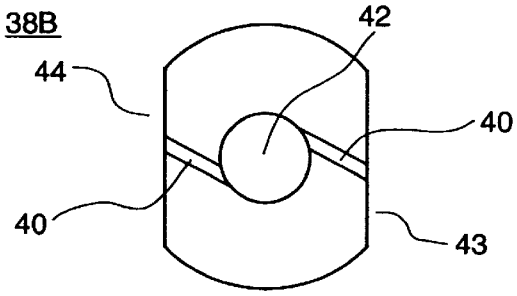
FIG. 4B is a plan view showing a further single plate 38B for constituting a further embodiment of the laminated layer structure fuel swirl element of the electromagnetic system fuel injector of FIG. 4A according to the present invention.
Figure 4C:
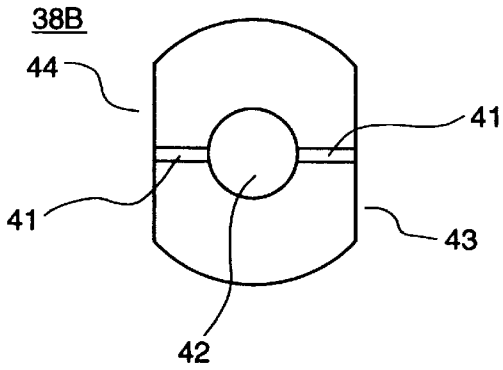
FIG. 4C is a bottom view showing the further single plate 38B for constituting the further embodiment of the laminated layer structure fuel swirl element of the electromagnetic system fuel injector of FIG. 4A according to the present invention.

FIG. 4A, FIG. 4B and FIG. 4C show a further embodiment of a laminated layer structure fuel swirl element 38 of the fuel injector 1 according to the present invention and this embodiment shows a two-piece structure fuel swirl element 38. FIG. 4A shows a longitudinal cross-section view of the two-piece structure fuel swirl element 38, FIG. 4B is a plan view showing a single plate 38B for constituting a further embodiment of the laminated layer structure fuel swirl element 38, and FIG. 4C is a bottom view showing the single plate 38B for constituting the further embodiment of the laminated layer structure fuel swirl element 38.

Namely, the two-piece structure fuel swirl element 38 is comprised a cylindrical shape portion 38A and another cylindrical shape portion (a single plate) 38B. The fuel swirl element 38 is separated but is joined and fixed and at the cylindrical shape portion 38A a guide hole 39 for guiding the movable portion 4A is provided. Further, at one end face or at an upper face of the another cylindrical shape portion (the single plate) 38B a pair of radial direction passages 40 of the fuel is provided and this radial direction fuel passage 40 is off-set from the axial center. At an another end face or at a lower face of the another cylindrical shape portion 38B a pair of radial direction passages 41 of the fuel is provided and the radial direction fuel passage 41 is not off-set.

Further, at a central portion, a central hole 42 is provided and this central hole 42 communicates with the respective radial direction fuel passages 40 and 41. This central hole 42 is formed to have the same diameter or the little large diameter of the guide hole 39 which is provided on the cylindrical shape portion 38A of the fuel swirl element 38. Further, on the cylindrical shape portion 38A and the another cylindrical shape portion (the single plate) 38B, as shown in FIG. 4B and FIG. 4C, a pair of cut faces 43 and 44 are provided.

When the cylindrical shape portion 38A and the another cylindrical shape portion 38B are inserted and fixed to the inner wall 21 at the central portion of the nozzle member 7, between two cut faces 43 and 44 and the inner wall 41 at the central portion the radial direction passage of the fuel is formed.

Since the another cylindrical shape portion 38B of this embodiment of the fuel injector 1 is manufactured similar to that of the first embodiment using the press formation working, the freedom degree in design of the radial direction fuel passages 40 and 41 is comparatively high and it is possible to manufacture with a high accuracy and the operation and the effects similar to the first embodiment are obtained.

As the fuel swirl impartment element means of the fuel injector, there is a case where an off-set amount of a radial direction swirl fuel passage at a side of the upstream is formed the same off-set amount of a radial direction swirl fuel passage at a side of the downstream. In this case constituted in above, the swirl force which is imparted at the upstream is weakened by a friction loss of a flow in which the fuel flows from an outlet port of the fuel swirl impartment passage to the injection hole and is composed or joined to a strong swirl force which is imparted at the downstream.

The swirl force at the upstream side is smaller than that of the downstream side, a following complex fuel spray is formed. Namely, after the fuel spray having the weak inertia force and the large spreading angle is sprayed, the fuel spray having the strong inertia force and the small spreading angle comes in the preceding fuel spray. After a voluntary time, this fuel spray has a droplet spatial distribution on a fuel spray lateral cross sectional face (at a lower portion of 50 mm from the injection hole) similarly to that of the first embodiment.

Further, in a case where the off-set of the fuel swirl passage at the upstream side is smaller than that of the fuel swirl passage at the downstream side, needless to say the above stated phenomenon becomes remarkably.

The structure in the internal combustion engine to the injection system for suitable to the complex fuel spray by the fuel injector do not limited to this embodiment but they can be constituted with most suitable form according to the carrying out embodiments of the complex fuel spray using the fuel injector according to the present invention.

Figure 5:
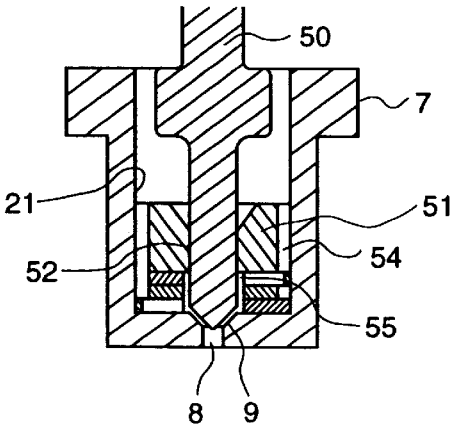
FIG. 5 is a cross-sectional view showing a further embodiment of a movable valve of a fuel swirl element of an electromagnetic system fuel injector according to the present invention.
Figure 6:
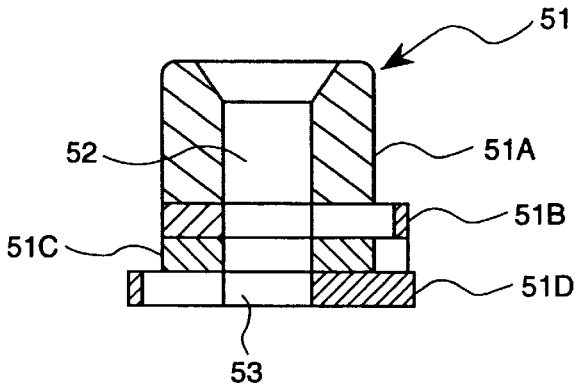
FIG. 6 is a longitudinal cross-sectional view showing a further more embodiment of a laminated layer structure fuel swirl element of an electromagnetic system fuel injector according to the present invention.

FIG. 5 and FIG. 6 show further embodiments according to the present invention in a case the movable valve is changed to a needle valve. FIG. 5 shows a cross-sectional view of an essential portion of a surrounding portion of a needle valve 50 and FIG. 6 shows a cross-sectional view of a laminated layer structure fuel swirl element 51. In these figures, the same reference numerals to the first embodiment show same components or elements shown in the first embodiment.

In FIG. 6, the laminated layer structure swirl element 51 comprises four pieces which are a cylindrical shape portion 51A, an upper plate 51B, a middle plate 51C, and a lower plate 51D and the construction of the laminated layer structure swirl element 51 is similar to that of the first embodiment. The cylindrical shape portion 51A has a guide hole 52 of a movable portion which is comprised of the needle valve 50.

The construction of the respective fuel passage of the three plates 51B, 51C and 51D is similar to that of the first embodiment. However, a central hole 53 which communicates with the fuel passage is formed to have a little larger diameter than the diameter of the guide hole 52.

In FIG. 5, after the four pieces comprised of the cylindrical shape portion 51A and the three plates 51B, 51C and 51D have laminated in series similar to the first embodiment, the above four pieces are inserted and fixed to the inner wall 21 of the hollow portion of the nozzle member 7. An axial direction passage 54 of the fuel is formed between an outer peripheral wall of the fuel swirl element 51 and the inner wall 21 of the hollow portion of the nozzle member 7.

Further, by inserting the movable portion (the needle valve 50), a fuel swirl chamber 55 is formed at a vicinity of a tip end of an outer peripheral portion of the needle valve 50. Namely, the fuel passage which is introduced from an upper portion of the needle valve 50 is constituted, the fuel which has passed through the axial direction passage 54 is introduced eccentrically through the upper plate 51B and then the fuel is imparted with a swirl force, accordingly the fuel has a spray having the weak inertia force and the wide spreading angle.

Further, the fuel spray having the strong inertia force and the small spreading angle is generated by the lower plate 51D which is arranged nearly a side of the seat face 9 of the nozzle member 7. This fuel spray is generated at a vicinity of the axial center as the fuel spray flow having the comparative large velocity. As a result, the fuel spray which forms the comparative solid cone fuel spray structure is generated.

FIG. 7A and FIG. 7B show a schematic view showing the fuel spray obtained by the embodiment according to the present invention from a photography which is taken an electric flash photograph. FIG. 7A is a schematic view showing a complex fuel spray structure in which a droplet flow is mainly explained according to the present invention, and FIG. 7B is a schematic view showing a complex fuel spray structure in which an air flow is mainly explained according to the present invention.

As stated in above, until the reach to the fuel injection hole 8 of the nozzle member 7, the fuel is separated the strong swirl flow from the upper portion of the axial direction and the weak swirl flow from the lower portion of the axial direction.

As a result, the small diameter droplets having the weak inertia force and the small velocity is generated at the outer peripheral portion of the fuel spray, the comparative small diameter droplets (larger than the above stated outer peripheral portion droplets) having the strong inertia force and the large velocity is generated at the central portion of the fuel spray.

The small diameter droplets at the outer peripheral portion of the fuel spray are received easily an affect of a surrounding air flow, as shown in FIG. 7A and FIG. 7B, the small diameter droplets are divided into the droplets which are directed for the center of the fuel spray and are attracted to the air flow and the droplets which are directed for a side of the downstream and are discharged toward an outside portion.

On the other hand, the comparative small diameter droplets having the large velocity at the central portion of the fuel spray attract the small diameter droplets at a vicinity which are accompanied with the air flow. As a result, the dispersion of the droplets is promoted and then the comparative solid cone fuel spray structure is appeared.

Further, as shown in FIG. 7A and FIG. 7B, taking into consideration from a cross sectional face of the fuel spray including the axial center of the valve body, the fuel spray structure of the fuel injector according to the present invention has three strong spray components with direct to D1 direction, D2 direction and D3 direction.

In other words, the fuel spray structure has three pattern spray components which are a straight pattern fuel spray component, a left radial pattern fuel spray component, and a right radial pattern fuel spray component. The straight pattern fuel spray component has D1 direction component and directs for the lower portion, the left radial pattern fuel spray component has D2 direction component and directs for the left radial portion, and the right radial pattern fuel spray component has D3 direction component and directs for the right radial portion. By uniting the straight pattern fuel spray component, the left radial pattern fuel spray component and the right radial pattern fuel spray component, the comparative solid cone fuel spray structure according to the present invention is formed.

From a different point of view, the above fuel spray structure according to the present invention comprises a central fuel spray structure and a peripheral fuel spray structure. The central fuel spray structure is formed by the fuel structure which directs to D1 direction and exists at the central portion of the fuel spray. On the other hand, the peripheral fuel spray structure is formed by the fuel structure which directs to D2 direction and D3 direction. The peripheral fuel spray structure is formed by surrounding the central fuel spray structure. By uniting the central fuel spray structure and the peripheral fuel spray structure, the comparative solid cone fuel spray structure according to the present invention is formed.

Figure 8:
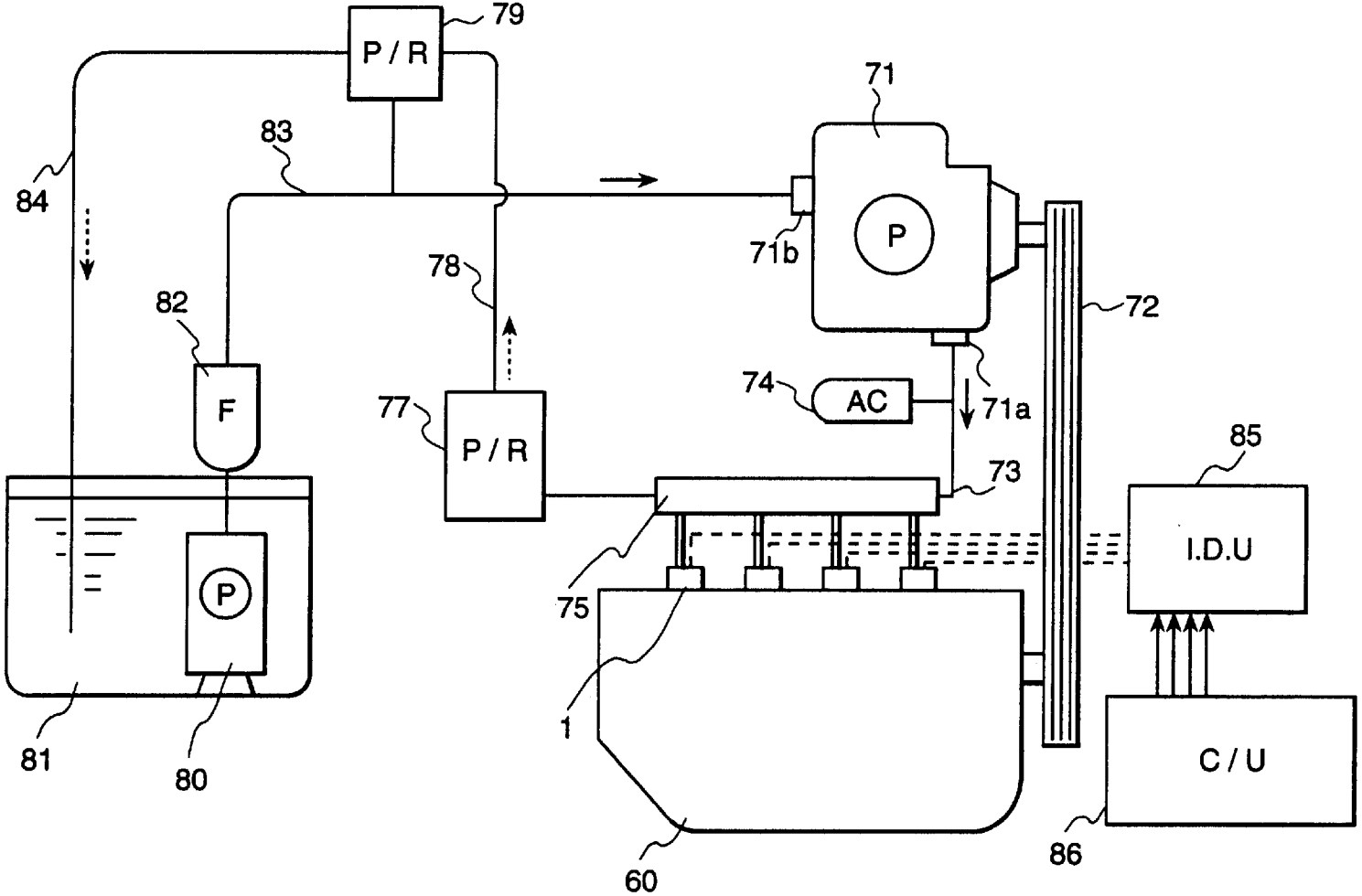
FIG. 8 is a block diagram showing one embodiment of an internal combustion engine having a fuel injector according to the present invention.

FIG. 8 shows a construction of an internal combustion engine such as an automobile in which one embodiment of an electromagnetic system injector according to the present invention and in the internal combustion engine the fuel is injected directly to a combustion chamber of the internal combustion engine. FIG. 9 shows an essential portion enlargement view of the direct fuel injection system internal combustion engine in which one embodiment of an electromagnetic system fuel injector according to the present invention.

In FIG. 8, a four-cylinder four cycle gasoline engine 60 is connected directly to a high pressure fuel pump 71 through a belt 72. The high pressure fuel pump 71 pressurizes the fuel according to a cum drive, for example, in the high pressure fuel pump 71 by moving a piston the hydraulic compression is carried out and then the high pressure fuel is obtained. The high pressure fuel pump 71 has a discharge port 71*a* and a suction port 71*b*. The discharge port 71*a* and a fuel gallery 75 of the engine 60 are connected by a high pressure piping 73 and an accumulator 74 is provided at a midway of the high pressure piping 73. To the fuel gallery 75, a direct fuel injection device 1 according to the present invention is arranged and fixed.

A high pressure regulator 77 is provided to a side of a downstream of the fuel gallery 75 and this high pressure regulator 77 maintains a supply pressure of the fuel to the direct fuel injection device 1 at constant. The superfluous fuel is introduced to a low pressure regulator 79 from the fuel gallery 77 through a lower pressure piping 78. Next, the superfluous fuel is passed through a return piping 84 which is connected to the lower pressure piping 79 and is returned to a fuel tank 81.

Plural direct fuel injection devices 1 are provided in response to a number of the cylinders. A driver circuit 85 for controlling the direct fuel injection device 1 is connected to a control unit 86 of the engine 60. The driver circuit 85 controls a supply amount etc. of the fuel to the direct fuel injection device 1 in accordance with various kinds commands from the control unit 86 of the engine 60. The operation of the engine 60 is controlled through the control unit 86 in accordance with the inhale air amount, the air temperature, the engine water temperature, the rotation number etc. which are the driving information.

Next, the above stated internal combustion engine 60 thus constituted will be explained in detail.

A piston 69 is provided enable to reciprocate in a cylinder 68, this piston 69 is moved upwardly and downwardly in the cylinder 68 in response to the rotation of an engine shaft (not shown in figure). A cylinder head 63 is installed at an upper portion of the cylinder 68 and this cylinder head 63 forms an airtight enclosed space in accompany with the cylinder 68.

At the cylinder head 63, an air intake manifold 62 and an air discharge manifold are formed. The air intake manifold 62 leads the outside air to the cylinder 68 through an inhale air amount control device 61 and the air discharge manifold 62 leads the combustion gas which is combusted in the cylinder 68 to the exhaust air device.

An air intake valve 64 is provided at a side of the air intake manifold 62 of the cylinder head 63 and an ignition device 65 is provided at a central portion of the air intake manifold 62, and further an air exhaust valve 66 is provided at an against side of the air intake valve 64. The air intake valve 64 and the air exhaust valve 66 are extended toward in a combustion chamber 67 of the engine 60.

Herein, the direct fuel injection device 1 according to the present invention in installed to a vicinity of a connection portion of the air intake manifold 62 of the cylinder head 63 and an injection direction of the fuel is set to direct for a little downward direction in the combustion chamber 67.

An installation angle θ p of the direct fuel injection device 1 is about 30°–40° degree. The piston 69 has a cavity 69A. In FIG. 9, a blank arrow mark shows the intake air flow and a hatching arrow mark shows the exhaust gas flow, respectively.

The fuel of the internal combustion engine 60 is injected directly into the combustion chamber 67 according to the direct fuel injection device 1 by suiting to a timing of the intake air. An ignition signal is formed that the control unit 86 carries out according to the driving condition of the engine 60. The sprayed fuel due to the injection in the combustion chamber 67 promotes the mixture with the air which is led through the air intake manifold 62. In this time, the fuel spray having the large velocity at the central portion of the fuel spray is regulated the flow direction by the cavity 69A of the piston 69.

Namely, as shown in a black arrow mark in FIG. 9, the flow direction of the fuel spray having the large velocity at the central portion of the fuel spray is directed for to the ignition device 65. On the other hand, the small diameter droplets having the small velocity at the outer peripheral portion of the fuel spray is dispersed in the combustion chamber 67 and the mixture with the air is promoted.

After that the mixture air is compressed during a compression stroke and is ignited stably in the ignition device 65, accordingly the discharge amount of the unburned gas is restrained and a stable combustion of the engine 60 can be realized.

As stated in above, according to the laminated layer structure fuel swirl element, at the remote side from the fuel injection hole the fuel is imparted the strong swirl flow and on the other hand at the near side to the fuel injection hole the fuel is imparted the weak swirl flow.

As a result, the fuel spray having the large velocity which is generated at the central portion of the fuel spray attracts the small diameter droplets which are generated at the outer peripheral portion of the fuel spray, therefore the fuel spray having the superior dispersion property can be formed.

Since the fuel spray thus obtained is supplied directly in the combustion chamber of the internal combustion engine, a good ignition property of the engine and also the exhaust amount of the unburned gas components of the combustion can be reduced.

Further, since the laminated layer structure fuel swirl element can be obtained by manufacturing the press punch-out working, a high manufacturing accuracy of the laminated layer structure fuel swirl element can be attained, further a low manufacturing cost of the laminated layer structure fuel swirl element can be attained.

In the above stated various embodiments, the electromagnetic fuel injector is subjected, however the driving means of the valve body is not limited to the electromagnetic type, for example, using a piazo-electric type element the valve body can be driven.

According to the present invention, by imparting the different swirl forces to the fuel, the fuel is injected, the fuel injector in which the complex fuel spray is generated, such a complex fuel spray structure has the fuel spray having the large wide spreading angle by making weak the inertia force and by making shorten the reach distance and the fuel spray having the small spreading angle by making strong the inertia force.

Further, using the above stated fuel injector to the internal combustion engine, a good ignition property of the internal combustion engine can be obtained and the discharge amount of the unburned gas components of the combustion can be reduced.

We claim:

1. A fuel injector comprising:

a fuel injection hole;

a valve seat arranged at an upstream side of said fuel injection hole; and a valve body for carrying out an opening operation and a closing operation of a fuel passage at said valve seat, wherein:

during fuel injection, two sprays having different penetration forces are injected by the fuel injector, said two sprays are overlapped in injection directions, and to one of said two sprays, droplets of the other of the two sprays are induced.

2. A fuel injection apparatus including a fuel injection hole, a valve seat arranged at an upstream side of said fuel injection hole, and a valve body for carrying out an opening operation and a closing operation of a fuel passage at said valve seat, and further comprising:

means for injecting two sprays having different penetration forces;

means for overlapping said two sprays in injection directions; and means for inducing droplets of one of the two sprays into the other of the two sprays.

3. An internal combustion engine including a fuel injector comprising:

a fuel injection hole;

a valve seat arranged at an upstream side of said fuel injection hole; and a valve body for carrying out an opening operation and a closing operation of a fuel passage at said valve seat, wherein:

during fuel injection, two sprays having different penetration forces are injected by the fuel injector, said two sprays are overlapped in injection directions, and to one of said two sprays, droplets of the other of the two sprays are induced.

* * * * *